US009949531B2

(12) United States Patent
Timco et al.

(10) Patent No.: US 9,949,531 B2
(45) Date of Patent: Apr. 24, 2018

(54) SHOE HOLE PREVENTION DEVICE

(71) Applicant: SHOE ARMOUR LLC, McDonald, PA (US)

(72) Inventors: Dan Timco, McDonald, PA (US); Kelly Timco, McDonald, PA (US)

(73) Assignee: SHOE ARMOUR LLC, McDonald, PA (US)

( * ) Notice: Subject to any disclaimer, the term of this patent is extended or adjusted under 35 U.S.C. 154(b) by 0 days.

(21) Appl. No.: 14/961,238

(22) Filed: Dec. 7, 2015

(65) Prior Publication Data

US 2016/0157555 A1 Jun. 9, 2016

Related U.S. Application Data

(60) Provisional application No. 62/088,341, filed on Dec. 5, 2014.

(51) Int. Cl.

| | |
|---|---|
| ***A43B 23/08*** | (2006.01) |
| ***A43B 17/00*** | (2006.01) |
| ***A43B 13/41*** | (2006.01) |
| ***A43B 17/16*** | (2006.01) |

(52) U.S. Cl.

CPC ..... *A43B 17/00* (2013.01); *A43B 13/41* (2013.01); *A43B 17/16* (2013.01); *A43B 23/081* (2013.01); *A43B 23/086* (2013.01)

(58) Field of Classification Search

CPC ..... A43B 13/41; A43B 17/16; A43B 23/08; A43B 23/081; A43B 23/086; A43B 23/087

USPC ..... 36/77 R, 77 M

See application file for complete search history.

(56) References Cited

U.S. PATENT DOCUMENTS

| | | | | | |
|---|---|---|---|---|---|
| 1,993,113 | A * | 3/1935 | Pinell | A43B 13/41 | 12/146 B |
| 2,584,516 | A * | 2/1952 | Veatch | A43B 19/00 | 36/55 |
| 2,776,500 | A * | 1/1957 | Gonsalves | A43B 17/16 | 36/10 |
| 3,410,007 | A * | 11/1968 | Peterson | A43B 7/32 | 36/77 R |
| 4,566,197 | A * | 1/1986 | Sitzes | A43B 23/086 | 36/11 |
| 5,185,945 | A * | 2/1993 | Nielsen | A43C 13/14 | 36/101 |
| 6,159,589 | A * | 12/2000 | Isenberg | A43B 23/086 | 36/72 R |

(Continued)

*Primary Examiner* — Marie Bays

(74) *Attorney, Agent, or Firm* — Pepper Hamilton LLP

(57) ABSTRACT

Shoe hole prevention inserts and methods for making same are described. A shoe insert may include a sole pad, a toe guard attached to a first position on the sole pad, and a sidewall guard attached to a second location on the sole pad. The toe guard may be connected to the sole pad such that the toe guard can be moved into a first insertion position. Similarly, the sidewall guard may be movably connected to the sole pad such that the sidewall guard can be moved into a second insertion position. Each of the sole pad, toe guard, and sidewall guard may include an adhesion area for adhering at least a portion of the shoe insert to at least a portion of the inside of a shoe. Thus, when inserted, the insert may prevent holes from forming due to rubbing against the inside of the shoe.

14 Claims, 6 Drawing Sheets

(56) References Cited

U.S. PATENT DOCUMENTS

| | | | | |
|---|---|---|---|---|
| 6,272,771 | B1 * | 8/2001 | Rodi | A61F 5/0111 36/110 |
| 6,598,323 | B1 * | 7/2003 | Gougelet | A43B 23/086 36/77 M |
| 6,895,694 | B2 * | 5/2005 | Nye | A43B 23/08 36/8.3 |
| 6,907,681 | B2 * | 6/2005 | Tanaka | A43B 23/087 36/77 M |
| 7,032,329 | B2 * | 4/2006 | Yang | A43B 23/087 36/77 M |
| 7,254,904 | B2 * | 8/2007 | Nye | A43B 23/08 36/8.3 |
| 8,186,080 | B2 * | 5/2012 | Favreau | A43B 3/0026 36/72 R |
| 8,955,237 | B2 * | 2/2015 | Rini | A43B 23/087 36/110 |
| 2003/0213149 | A1 * | 11/2003 | Woods | A43B 3/00 36/110 |
| 2004/0093761 | A1 * | 5/2004 | Nye | A43B 23/08 36/8.3 |
| 2005/0144809 | A1 * | 7/2005 | Yang | A43B 23/087 36/77 R |
| 2005/0198861 | A1 * | 9/2005 | Nye | A43B 23/08 36/8.3 |
| 2006/0070262 | A1 * | 4/2006 | Shaw | A43B 23/087 36/77 R |
| 2007/0289165 | A1 * | 12/2007 | Sartor | A43B 23/086 36/77 R |
| 2008/0141565 | A1 * | 6/2008 | Rini | A43B 23/087 36/77 R |
| 2011/0119810 | A1 * | 5/2011 | Diaz | A43B 1/0045 2/239 |

* cited by examiner

SHOE HOLE PREVENTION DEVICE

CROSS-REFERENCE TO RELATED APPLICATIONS

This application claims the priority benefit of U.S. Provisional Application No. 62/088,341, entitled "Shoe Hole Prevention Device" filed Dec. 5, 2014, the contents of which is hereby incorporated by reference in its entirety.

BACKGROUND

Athletic shoes, for example, running or cross-training shoes, are generally designed to provide a greater degree of comfort and support to the feet of a wearer while minimizing size and overall weight. As such, lighter-weight materials are typically used in the manufacture of athletic shoes. To maintain comfort, athletic shoes are typically made from flexible materials such as foam and rubber. In order to reduce weight, the materials are generally made as thin as possible. Additionally, partially open materials such as mesh or other woven materials may be used to manufacture one or more portions of an athletic shoe such as the top of the toe box or the inner/outer sidewalls of the shoes.

By reducing the overall weight (and, as a result, the thickness of the materials used), durability of the athletic shoes is negatively impacted. Damage to an athletic shoe, whether merely cosmetic or directly related to the comfort and/or functionality of the shoe, is common no matter how well cared for the shoes are. For example, for a typical running shoe, the wearer puts a large amount of pressure on various parts of the shoe through normal activity, such as running or walking. Similarly, during normal activity, the wearer's foot can rub against inner portions of the shoe, weakening those portions and potentially creating one or more holes. For example, a runner may develop a hole on the top of a toe box of a running shoe after a period of typical usage of the shoe. Thus, through no misuse of the shoe on the part of the wearer, the shoe can be rendered cosmetically or functionally damaged with little or no means of prevention.

BRIEF DESCRIPTION OF THE DRAWINGS

The above and other objects of the present invention will become more readily apparent from the following detailed description taken in connection with the accompanying drawings.

SUMMARY

Figure 1A:
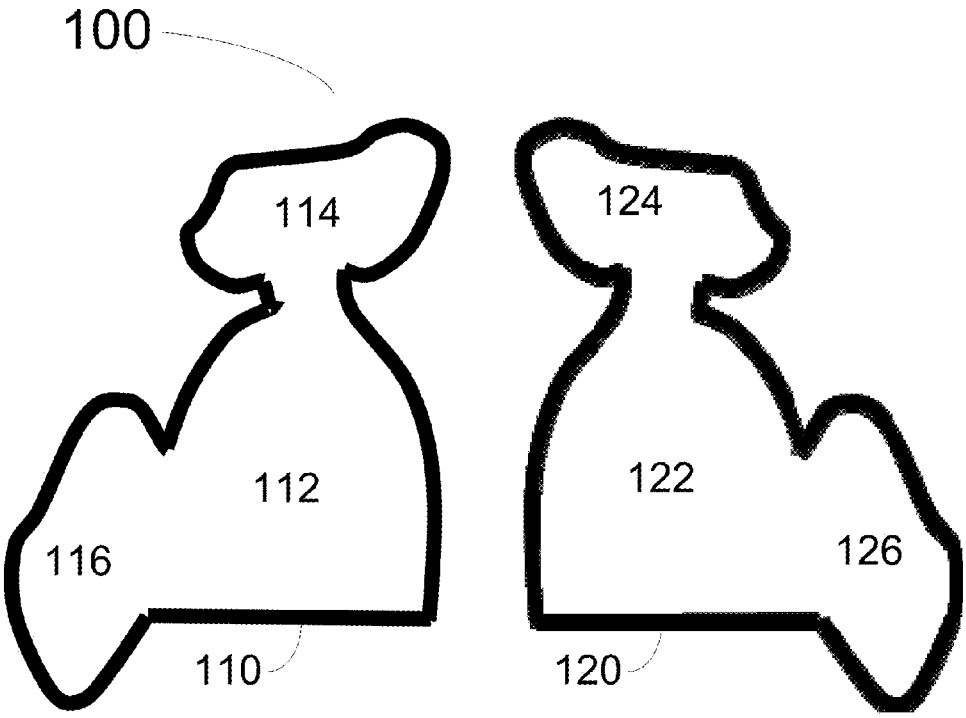
FIGS. 1A and 1B depict a shoe hole prevention device according to one or more embodiments as described herein.

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

In an embodiment, a shoe insert includes a sole pad, a toe guard attached to a first position on the sole pad, and a sidewall guard attached to a second location on the sole pad. The toe guard is configured to be movably connected to the sole pad such that the toe guard can be moved into a first insertion position. Similarly, the sidewall guard is configured to be movably connected to the sole pad such that the sidewall guard can be moved into a second insertion position.

In another embodiment, a system for preventing holes in a pair of shoes includes a left shoe insert and a right shoe insert. The left shoe insert includes a left sole pad, a left toe guard attached to the left sole pad, the left toe guard configured to be movably connected to the left sole pad such that the left toe guard can be moved into a first insertion position, and a left sidewall guard attached to the left sole pad, the left sidewall guard configured to be movably connected to the left sole pad such that the left sidewall guard can be moved into a second insertion position. Similarly, the right shoe insert includes a right sole pad, a right toe guard attached to the right sole pad, the right toe guard configured to be movably connected to the right sole pad such that the right toe guard can be moved into a third insertion position, and a right sidewall guard attached to the right sole pad, the right sidewall guard configured to be movably connected to the right sole pad such that the right sidewall guard can be moved into a fourth insertion position.

In another embodiment, a method of manufacturing a shoe insert includes providing a sole pad, attaching a toe guard to a first position on the sole pad, the toe guard configured to be movably connected to the sole pad such that the toe guard can be moved into a first insertion position, and attaching a sidewall guard to a second location on the sole pad, the sidewall guard configured to be movably connected to the sole pad such that the sidewall guard can be moved into a second insertion position.

DETAILED DESCRIPTION

The present disclosure generally relates to a shoe hole prevention device (or "insert"). In some embodiments, the shoe hole prevention device may be incorporated as an insert that is configured to comfortably fit within a shoe. The shoe hole prevention device as described herein may be configured to prevent holes from forming in common wear areas of a shoe by providing additional material in areas likely to develop holes from typical wear.

As described above, shoes often wear from the inside out and holes can form from parts of the foot rubbing repeatedly on the inside of the shoe or from forces from the foot pressing on the shoe. The shoe hole prevention device may operate to prevent holes, tears, rips, fraying, and/or other types of wear thereby resulting in longer lasting shoes.

Additionally, the shoe hole prevention device as described herein may be used in a shoe with an existing hole, providing additional coverage and protection while prolonging the remaining life of the shoe. The shoe hole prevention device may be constructed from and/or include, for example, ballistic materials, including fabrics and/or fibers. Non-limiting examples of ballistic materials may include aramid fibers, para-aramid fibers, Kevlar®, Twaron®, and/or ballistic materials developed for military body armor. Ballistic materials have superior abrasion and tear resistance when compared to materials typically used for shoe manufacture or repair, making ballistic materials a well-suited material for preventing holes. However, embodiments are not limited to the use of ballistic materials as any type of material capable of operating according to some embodiments is contemplated herein. In some embodiments, materials used to form the shoe hole prevention device may include ballistic materials, polymer materials, foam materials, cotton, nylon, polyester, leather, rubber, carbon rubber, nitrile rubber, ethylene vinyl acetate, silicone, polyurethane, carbon, suede, and any combination thereof. Additionally, the shoe hole prevention device may have adhesive positioned at various places for adhering the shoe hole prevention device to one or more places within the shoe. The shoe hole prevention device as described herein is discussed in greater detail below in regard to the accompanying figures.

FIG. 1A illustrates a pair 100 of shoe hole prevention inserts configured to be positioned within a shoe to aid in the prevention of holes caused by a wearer's foot rubbing against the inside of the shoe. As shown in FIG. 1A, pair 100 may include, for example, a left insert 110 and a right insert 120. The left insert 110 may include a centrally located sole pad 112. A toe guard 114 may be attached to the top of the sole pad 112. Similarly, a sidewall guard 116 may be attached to the left side of the sole pad 112. The right insert 120 may also include a centrally located sole pad 122. A toe guard 124 may be attached to the top of the sole pad 122. Similarly, a sidewall guard 126 may be attached to the left side of the sole pad 122.

It should be noted that the shape and position of the various components as shown in FIG. 1A is by way of non-limiting example only. Based upon the design and intended use of the shoe inserts, one or more components as shown in FIG. 1A may be altered accordingly. For example, the shape of the toe guards 114, 124 may be chosen such that the toe guards fit a large number of existing running shoe styles without additional modification. However, a shoe manufacturer may opt to design a pair of inserts for a specific model of running shoe. In such an example, the toe guards 114, 124 may be sized and shaped accordingly to fit within one or more particular running shoe models. Although running shoes are used as examples herein, embodiments are not so limited, as any type of shoe capable of using a shoe insert 110, 120 is contemplated herein.

In some embodiments, the toe guards 114, 124 may have a "toe guard shape" as depicted in FIG. 1A that is configured to facilitate the coverage of a front portion of a foot when inserted into footwear. In some embodiments, the sidewall guards 116, 126 may have a "sidewall guard shape" as depicted in FIG. 1A that is configured to facilitate the coverage of a side portion of a foot when inserted into footwear.

Though not shown in FIG. 1A, the toe guards 114, 124 may be configured such that they are movably attached to the sole pads 112, 122. For example, toe guard 114 may be configured such that the toe guard may be folded into a position substantially perpendicular to the sole pad 112. In another example, toe guard 114 may be configured such that the toe guard may be folded in an upward direction with respect to the sole pad 112 and around a front portion of the foot (for instance, similar or substantially similar to the front portion of the toe box). Similarly, the sidewall guard 116 may also be configured to be movably attached to the sole pad 112 such that the sidewall guard may be folded into a position substantially perpendicular to the sole pad. For instance, sidewall guard 116 may be configured such that the sidewall guard may be folded in an upward direction with respect to the sole pad 112 and around a side portion of the foot (for instance, similar or substantially similar to the side portion of the toe box).

By folding the toe guard 114 and the sidewall guard 116, the left insert 110 may fit easily into a particular shoe. Once inserted, the toe guard 114 and the sidewall guard 116 may be properly positioned to provide adequate support and reinforcement. In some embodiments, the portion of the shoe insert 110, 120 where the toe guard 114, 124 meets the pad 112, 122 may be perforated, pleated, creased, or otherwise shaped to facilitate the folding or other movement of the toe guard 114, 124. In some embodiments, the portion of the shoe insert 110, 120 where the sidewall guard 116, 126 meets the pad 112, 122 may be perforated, pleated, creased, or otherwise shaped to facilitate the folding or other movement of the sidewall guard 116, 126. In some embodiments, the toe guard 114, 124 and/or the sidewall guard 116, 126 may be configured to be removed from the pad 112, 122.

The shoe inserts 110, 120 as illustrated in FIG. 1A and described above may be manufactured from various materials common in shoe construction and manufacture. For example, the inserts may be manufactured from a lightweight rubber, a flexible and padded foam such as polyethylene, and various fabrics such as nylon fabrics. In one embodiment, the inserts may be manufactured from a ballistics fabric, thereby providing adequate strength while maintaining a small size and light weight.

Figure 1B:
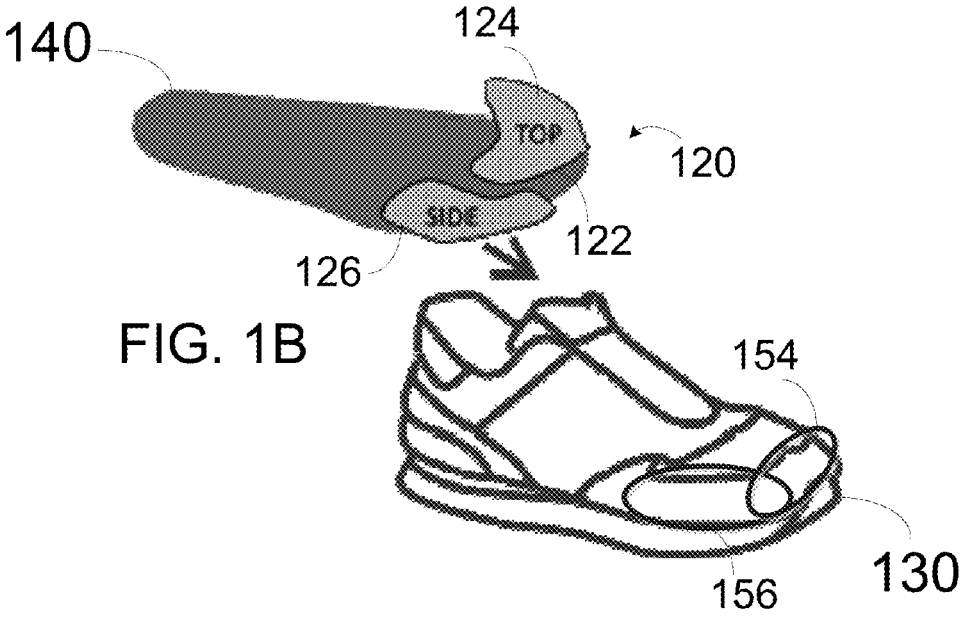

FIG. 1B depicts a right insert 120 as configured when inserted into footwear 130. As shown in FIG. 1B, the right insert 120 may be positioned at the front- or toe-end of the sole 140 of the footwear 130. In some embodiments, the sole pad 122 may be arranged under the sole 140. In some embodiments, the sole pad 122 may be arranged on top of the sole 140. The sidewall guard 126 may be folded in an upward direction, away from the sole pad 122. In this manner, the sidewall guard 126 may be positioned between the side and/or front portion of the foot (for instance, the right side of the foot and/or the right-most toes of the foot for the right insert 120) and the inner sidewall or portion of the inner sidewall of the footwear 130. For instance, the sidewall guard 126 may curve around and/or envelope a side portion of the front portion of the foot. In some embodiments, the sidewall guard 126 may be held in place by adhering the sidewall guard to in inner portion of the shoe. The toe guard 124 may be folded in an upward direction, away from the sole pad 122. In this manner, the toe guard 124 may be positioned between a front portion of the foot and the inner sidewall or portion of the inner sidewall of the footwear 130. For instance, the toe guard 124 may curve around and/or envelope a front portion of the foot, including at least a portion of the toes of the foot. In some embodiments, the toe guard 124 may be held in place by adhering the sidewall guard to in inner portion of the shoe In some embodiments, the toe guard 124 may operate to prevent wear in a region demarcated by area 154. For instance, area 154 may include a front and/or top portions of the toe box of the footwear 130. In some embodiments, the sidewall guard 126 may operate to prevent wear in a region demarcated by area 156. For instance, area 156 may include a side and/or top portion of the front portion of the footwear 130. Embodiments are not limited to preventing wear in areas 154 and 156, as these are depicted for illustrative purposes only. Indeed, the shoe inserts 110, 120 may be configured to prevent wear in additional areas of the footwear 130.

Figure 2A:
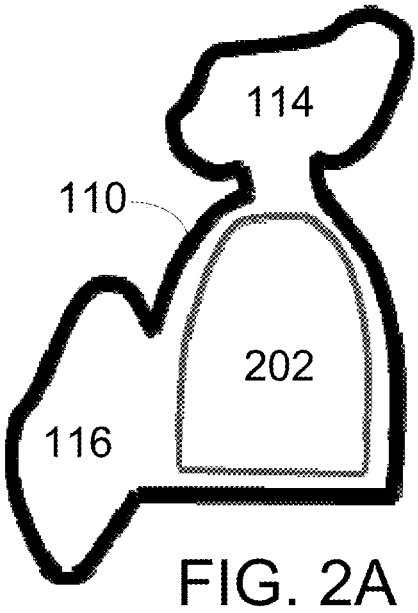
FIGS. 2A and 2B depict multiple views of a shoe hole prevention device according to one or more embodiments as described herein.
Figure 2B:
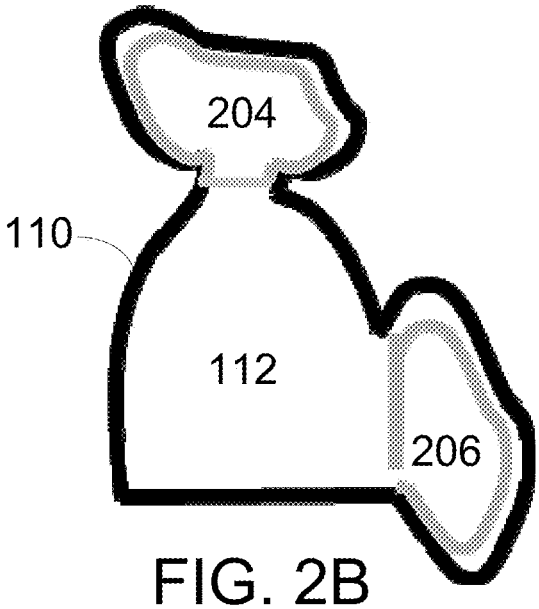

FIGS. 2A and 2B illustrate front (FIG. 2A) and back (FIG. 2B) views of left shoe insert 110, including various adhesion areas for adhering the insert 110 into a shoe. As shown in FIG. 2A, a sole pad adhesion area 202 may be provided on the front side of the insert 110, covering at least a portion of the sole pad 112. The sole pad adhesion area 202 may be positioned and configured to removably or semi-permanently adhere the sole pad 112 to one or more portions of, for example, a running shoe. In some embodiments, the sole pad adhesion area 202 may be used to affix the sole pad 112 to a removable sole of a shoe. In some embodiments, the sole pad adhesion area 202 may be used to affix the sole pad 112 to the inner bottom portion of a shoe, for instance, the sole or an area configured to receive a removable sole.

Figure 3A:
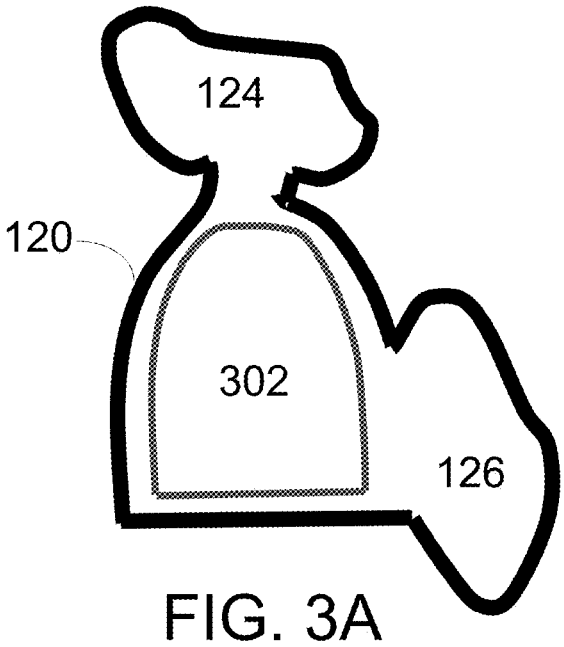
FIGS. 3A and 3B depict multiple views of a second shoe hole prevention device according to one or more embodiments as described herein.
Figure 3B:
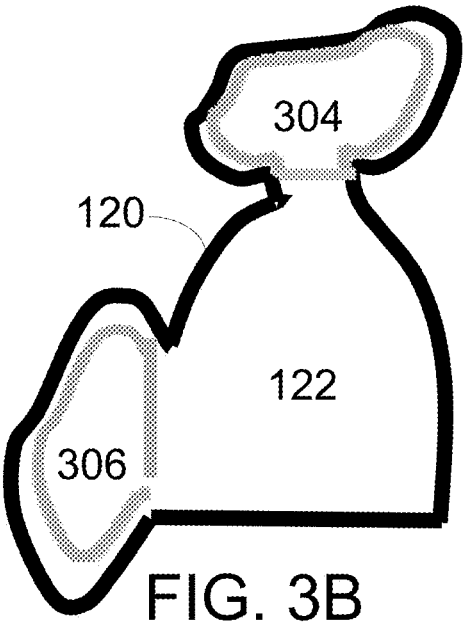

As shown in FIG. 2B, a toe guard adhesion area 204 and a sidewall adhesion area 206 may be provided on a back side of toe guard 114 and sidewall guard 116 respectively. The toe guard adhesion area 204 may be positioned and configured to removably or semi-permanently adhere the toe guard 114 to at least a portion of a toe box of the running shoe. Similarly, the sidewall guard adhesion area 206 may be positioned and configured to removably adhere the sidewall guard 116 to at least a portion of a sidewall of the running shoe. By using the adhesion areas 202, 204 and 206, the insert 110 may be securely inserted into the shoe while being removable for cleaning, replacement, reposition, or the like Similarly, FIGS. 3A and 3B illustrate front (FIG. 3A) and back (FIG. 3B) views of the right shoe insert 120, including various adhesion areas for adhering the insert 120 into a shoe. As shown in FIG. 3A, a sole pad adhesion area 302 may be provided on the front side of the insert 120, covering at least a portion of the sole pad 122. The sole pad adhesion area 302 may be positioned and configured to removably adhere the sole pad 122 to a removable sole from, for example the running shoe as described above in regard to FIGS. 2A and 2B. As shown in FIG. 3B, a toe guard adhesion area 304 and a sidewall adhesion area 306 may be provided on a back side of toe guard 124 and sidewall guard 126 respectively. The toe guard adhesion area 304 may be positioned and configured to removably adhere the toe guard 124 to at least a portion of a toe box of the running shoe. Similarly, the sidewall guard adhesion area 306 may be positioned and configured to removably adhere the sidewall guard 126 to at least a portion of a sidewall of the running shoe. By utilizing the adhesion areas 302, 304 and 306, the insert 120 may be securely inserted into the shoe while being removable for cleaning or replacement.

The adhesion areas as described in regard to FIGS. 2A, 2B, 3A, and 3B may include various adhesives or other common fasteners for removably attaching multiple objects. For example, adhesives such as an acrylic or other similar fabric adhesives may be applied to the adhesion areas. Alternatively, non-tacky fasteners such as hook-and-loop fasteners and micro-setae fasteners can be used.

Figure 4:
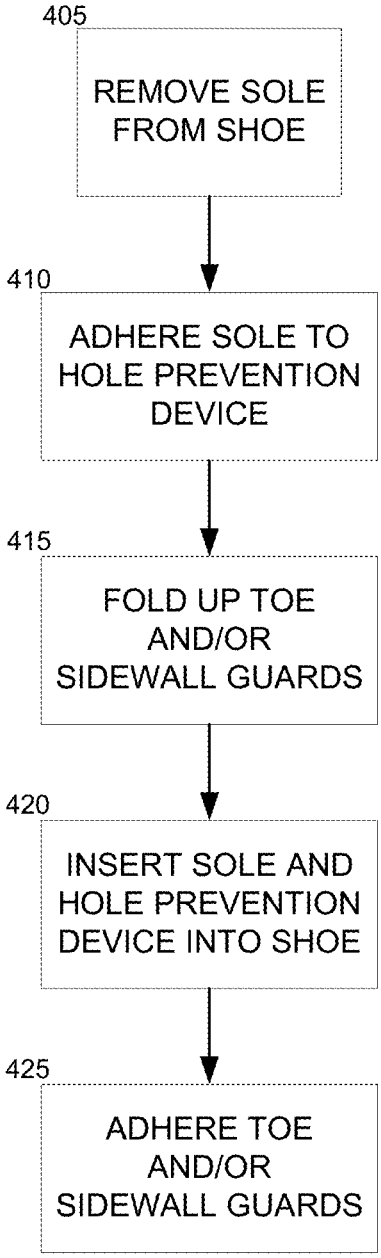
FIG. 4 depicts a sample process flow for using one or more shoe hole prevention devices according to one or more embodiments as described herein.

FIG. 4 illustrates a sample process flow for using the shoe hole prevention devices and inserts as described herein to prevent holes caused by internal rubbing of the foot against a shoe in the toe area and/or the sidewall area. A wearer of the shoes may remove 405 a removable sole from their shoe to be protected. For example, most athletic shoes come with a removable sole such that the sole can be adjusted and/or replaced. Alternatively or additionally, the wearer may opt to purchase a new sole rather than re-use the original sole that came with the shoe when purchased. Alternatively or additionally, the shoe hole prevention devices and inserts as described herein may be designed to be used without removing the sole. However, such a step is described herein with respect to FIG. 4 for illustrative purposes only.

The sole may then be adhered 410 to the sole pad of the shoe insert. For example, this may include removing a removable backing from a pre-applied adhesive on the sole pad and placing the sole on the sole pad. Alternatively, this may include applying an adhesive or other fastener to either the sole or the sole pad and adhering 410 the sole pad to the sole.

The toe guard and/or sidewall guard may be folded 415 or otherwise manipulated into one or more insertion positions. Based upon the preferences of the wearer of the shoe, either the toe guard or the sidewall guard may be removed from the insert. While this may limit the protection offered to that area of the shoe, the wearer's personal comfort preferences may result in their decision to remove one of the guards. At this point, a pre-applied adhesive may be exposed on both (or either) the toe guard and the sidewall guard or, alternatively, an adhesive or other fastener may be applied to both (or either) the toe guard and the sidewall guard.

The now assembled and adhered sole and hole prevention device may then be inserted 420 into the shoe to prevent wear of portions of the shoe. This may include sliding the assembly into the shoe until the toe guard hits the front of the toe box of the shoe. Alternatively, if the toe guard has been removed, inserting 420 may include positioning the assembly such that the shoe sole is properly in position. At his stage, the toe guard and/or the sidewall guard may be adhered 425 to the shoe. For example, a light pressure may be applied to the toe guard such that the toe guard adheres to at least a portion of the toe box of the shoe. Similarly, a light pressure may be applied to the sidewall guard such that the sidewall guard adheres to at least a portion of the sidewall of the shoe.

It should be noted that the process as shown in FIG. 4 is provided by way of example only. Based upon the construction and/or implementation of the shoe hole prevention device and insert as described herein, one or more of the process steps as described above may be altered, performed in an alternate order, or otherwise omitted. Similarly, additional steps may be added. For example, if the shoe insert is designed and sized for a specific size and model of shoe, the insert may include a full sole specifically sized for that model shoe. Thus, the step of adhering the sole pad to the sole may be eliminated. Alternatively, if the shoe insert is designed to fit a wide range of shoe models and sizes, additional steps such as trimming the shoe insert to size based upon the shoe being protected may be included in the process flow.

Figure 5:
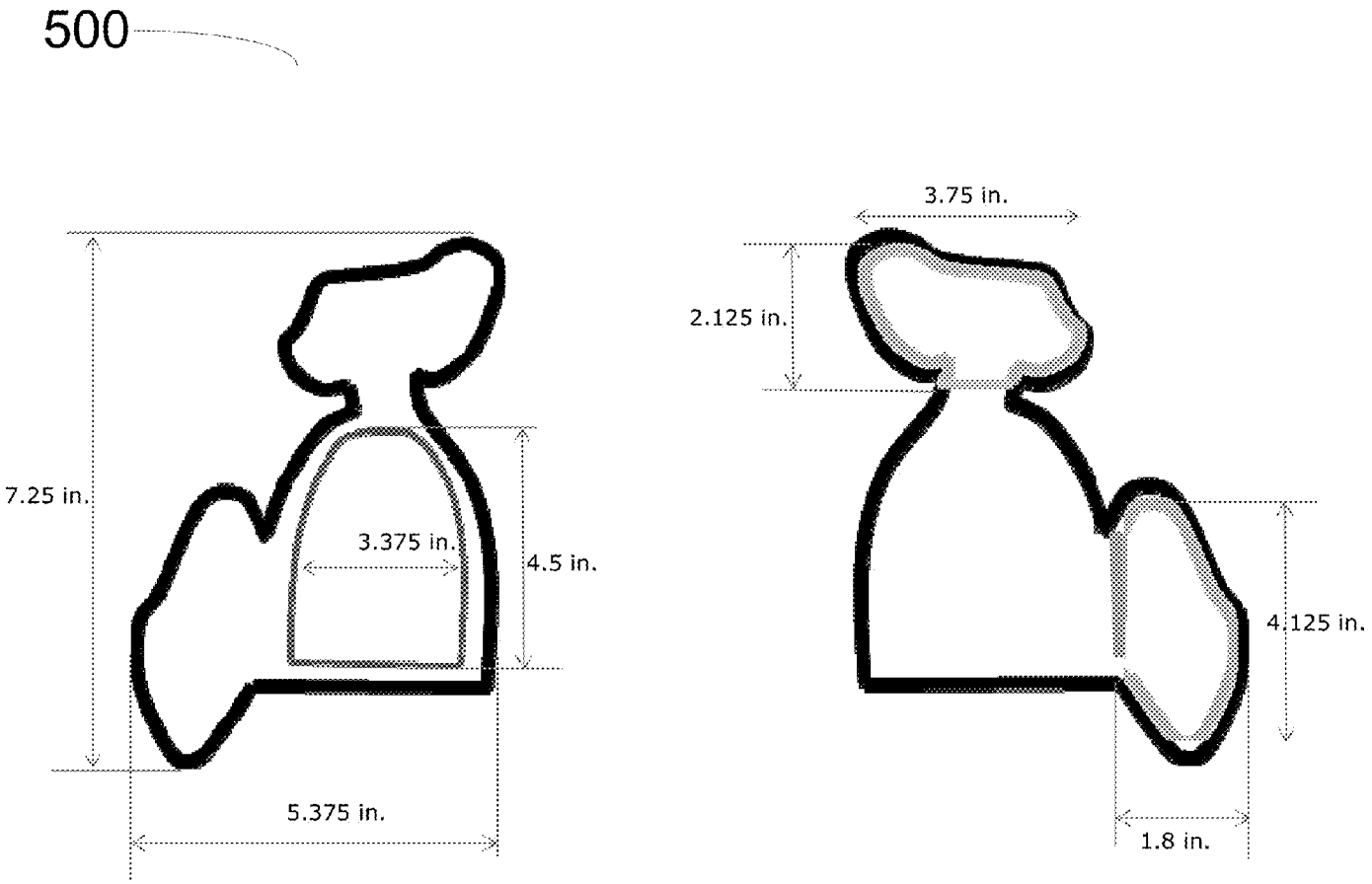
FIG. 5 depicts a specific example of a set of shoe hole prevention devices according to one or more embodiments as described herein.

FIG. 5 illustrates a specific example of a shoe insert pair 500 including a specific set of dimensions. The shoe insert pair 500 may be, for example, sized to fit a specific size or range of sizes. For example, the shoe insert pair may be sized to fit men's U.S. sizes 3-13, women's U.S. sizes 4-12, children's U.S. sizes (little kid) 7-13 and (big kid) 1-7, and all sizes and ranges between any two of these values (including endpoints), and any narrow, medium, wide, and/or extra wide versions thereof.

The shoe inserts and portions thereof, including the pad, side guards, and toe guards, may have various dimensions.

As shown in FIG. 5, the total width of a shoe insert may be about 5.375 inches, and the height may be about 7.25 inches. In some embodiments, the total width of a shoe insert may be about 3 inches, about 4 inches, about 5 inches, about 6 inches, about 7 inches, or any value or range between any two of these values (including endpoints). In some embodiments, the total height of a shoe insert may be about 3 inches, about 4 inches, about 5 inches, about 6 inches, about 7 inches, about 8 inches, about 9 inches, about 10 inches, or any value or range between any two of these values (including endpoints). The toe guard may have a width of about 1 inch, about 2 inches, about 3 inches, about 3.75 inches, about 4 inches, about 5 inches, about 6 inches, or any value or range between any two of these values (including endpoints). The toe guard may have a height of about 1 inch, about 2 inches, about 2.125 inches in height, about 3 inches, about 3.75 inches, about 4 inches, about 5 inches, or any value or range between any two of these values (including endpoints). The sidewall guard may have a width of about 1 inch, about 1.8 inches, about 2 inches, about 3 inches or any value or range between any two of these values (including endpoints). The sidewall guard may have a height of about 1 inch, about 2 inches, about 3 inches, about 4 inches, about 4.125 inches, about 5 inches, about 6 inches, about 7 inches, or any value or range between any two of these values (including endpoints). The adhesion areas on the inserts may be sized based upon the size of the area they are positioned. For example, the sole pad adhesion area, as shown in FIG. 5, may have a width of about 1 inch, about 2 inches, about 3 inches, about 3.375 inches, about 4 inches, about 5 inches, about 6 inches, or any value or range between any two of these values (including endpoints). The sole pad adhesion area may have a height of about 1 inch, about 2 inches, about 3 inches, about 4 inches, about 4.5 inches, about 5 inches, about 6 inches, about 7 inches, or any value or range between any two of these values (including endpoints). In some embodiments, the sole pad adhesion area may be shaped or substantially shaped to fit within the sole pad area. Similarly, the toe guard adhesion area and the sidewall adhesion areas may be sized to fit or to substantially fit on the toe guard and sidewall guard, respectively. In some embodiments, a shoe insert may have a thickness of about 0.01 inches, about 0.02 inches, about 0.03 inches, about 0.04 inches, about 0.05 inches, about 0.10 inches, about 0.20 inches, about 0.3 inches, about 0.5 inches, or any value or range between any two of these values (including endpoints).

Additionally, the specific example of shoe inserts as shown in FIG. 5 may be manufactured from a coated nylon fabric having a thickness of approximately 0.020 inches, or 0.5 mm. Additionally, the adhesion areas may include a polyester film that is double coated with a high tack acrylic adhesive having a thickness of approximately 3.5 mils on each side.

It should be noted that FIG. 5 illustrates a specific exemplary embodiment of the shoe hole prevention devices and inserts as described herein. The details provided in FIG. 5 are by way of example only and are not meant to limit the scope of the present disclosure.

Figure 6A:
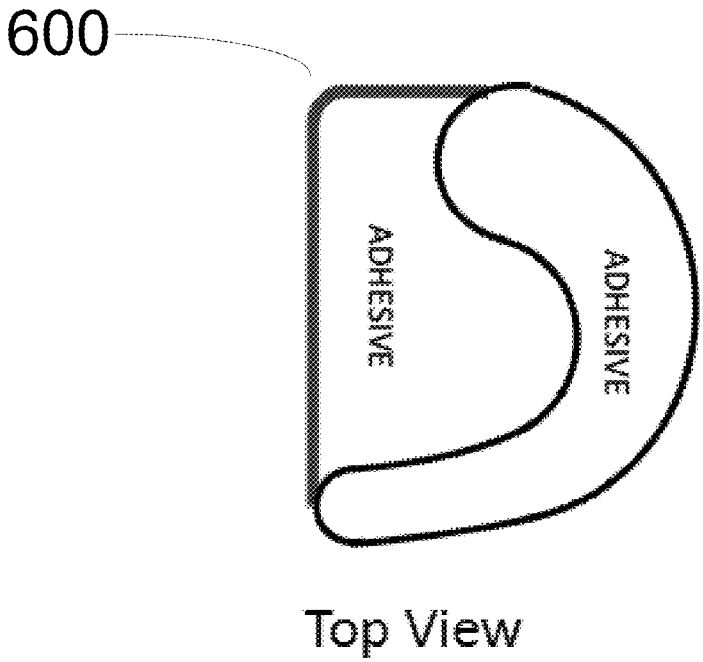
FIGS. 6A and 6B depict an additional example of a hole prevention device according to one or more embodiments as described herein.
Figure 6B:
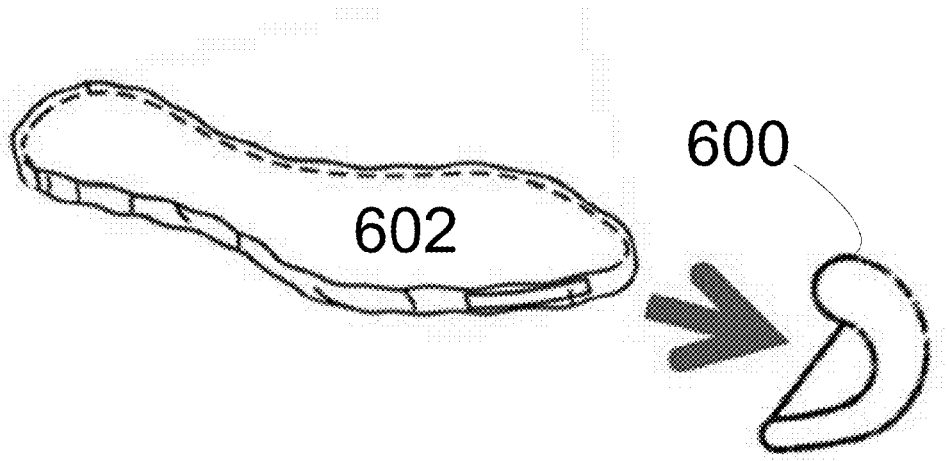

FIGS. 6A and 6B illustrate an alternative design for a shoe hole prevention device. As shown in FIG. 6A, insert 600 may be pre-formed to fit within a toe-box area of a shoe, thereby providing protection and added hole prevention to a wearer. The insert 600 may be shaped such that a portion of the insert provides additional support and protection to a sidewall area of the shoe as well. The insert 600 may also include adhesion areas for removably attaching the insert to one or more portions of the shoe. For example, there may be an adhesion area on the sole pad area of the insert 600 for adhering the insert to the sole of a shoe, as well as a second adhesion area on the toe guard area of the insert for adhering the insert to at least a portion of the toe box area of the shoe. As shown in FIG. 6B, an insole 602, removed from a shoe, may be placed onto the sole pad adhesion area (similar to the adhesion as described above in regard to FIG. 4), and the adhered assembly may be placed into the shoe such that the second adhesion area on the toe guard of the insert attaches to a portion of the toe box of the shoe.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to"). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (for example), the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, or the like. As a non-limiting example, each range discussed herein can be readily broken down into a lower third, a middle third, and an upper third. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A shoe insert comprising:

a sole pad having a top, bottom, and a side;

a first attachment comprising a toe guard attached to the top of the sole pad, the toe guard configured to be movably connected to the sole pad such that the toe guard can be moved into a first insertion position; and a second attachment comprising a sidewall guard attached to the side of the sole pad, the sidewall guard configured to be movably connected to the sole pad such that the sidewall guard can be moved into a second insertion position;

wherein a portion of the sidewall guard extends beyond the bottom of the sole pad.

2. The shoe insert of claim 1, wherein the sole pad comprises a first adhesion area positioned such that the sole pad can be adhered a first inner portion of the shoe.

3. The shoe insert of claim 2, wherein the toe guard comprises a second adhesion area positioned such that the toe guard can be adhered to a second inner portion of the shoe.

4. The shoe insert of claim 3, wherein the sidewall guard comprises a third adhesion area positioned such that the sidewall guard can be adhered to a third inner portion of the shoe.

5. The shoe insert of claim 4, wherein the first adhesion area, the second adhesion area and the third adhesion area comprise at least one of a hook-and-loop fastener, a microsetae fastener, and an adhesive.

6. The shoe insert of claim 1, wherein the sole pad, the toe guard and the sidewall guard are made from at least one of rubber, foam, and nylon fabric.

7. The shoe insert of claim 1, wherein the sole pad, the toe guard and the sidewall guard are made from a ballistic material selected from the group consisting of aramid fibers, para-aramid fibers, and para-aramid synthetic fiber.

8. A shoe insert comprising:

a sole pad having a top, bottom, and a side, the sole pad being constructed of a ballistic material selected from the group consisting of aramid fibers, para-aramid fibers, and para-aramid synthetic fiber;

a toe guard, constructed of a ballistic material selected from the group consisting of aramid fibers, para-aramid fibers, and para-aramid synthetic fiber, attached to the top of the sole pad, the toe guard configured to be movably connected to the sole pad such that the toe guard can be moved into a first insertion position, and a sidewall guard, constructed of a ballistic material selected from the group consisting of aramid fibers, para-aramid fibers, and para-aramid synthetic fiber, attached to the side of the sole pad, the sidewall guard configured to be movably connected to the sole pad such that the sidewall guard can be moved into a second insertion position;

wherein a portion of the sidewall guard extends beyond the bottom of the sole pad.

9. The system of claim 8, wherein:

The sole pad comprises a first adhesion area positioned such that the sole pad can be adhered to a first inner portion of a shoe;

the toe guard comprises a second adhesion area positioned such that the toe guard can be adhered to a second inner portion the shoe; and the sidewall guard comprises a third adhesion area positioned such that the sidewall guard can be adhered to a third inner portion of the shoe.

10. The system of claim 9, wherein the first adhesion area, the second adhesion area and the third adhesion area comprise at least one of a hook-and-loop fastener, a micro-*setae* fastener, and an acrylic adhesive.

11. A shoe insert comprising:

a sole pad having a top, bottom, and a side, the sole pad being constructed of a coated nylon fabric;

a toe guard, constructed from a coated nylon fabric, attached to the top of the sole pad, the toe guard configured to be movably connected to the sole pad such that the toe guard can be moved into a first insertion position; and a sidewall guard, constructed from a coated nylon fabric, attached to the side of the sole pad, the sidewall guard configured to be movably connected to the sole pad such that the sidewall guard can be moved into a second insertion position;

wherein a portion of the sidewall guard extends beyond the bottom of the sole pad.

12. The shoe of claim 11, further comprising configuring the sole pad to comprise a first adhesion area positioned such that the sole pad can be adhered a first inner portion of the shoe.

13. The shoe of claim 12, further comprising configuring the toe guard to comprise a second adhesion area positioned such that the toe guard can be adhered to a second inner portion of the shoe.

14. The shoe of claim 13, further comprising configuring the sidewall guard a third adhesion area positioned such that the sidewall guard can be adhered to a third inner portion of the shoe.

* * * * *